US005197938A

United States Patent [19]

Chmielewski

[11] Patent Number: 5,197,938

[45] Date of Patent: Mar. 30, 1993

[54] WASTE REMOVER FOR DIE CUT BLANKS

[75] Inventor: Jan Chmielewski, Brooklyn, N.Y.

[73] Assignee: International Stripping & Die Cutting Corp., Brooklyn, N.Y.

[21] Appl. No.: 786,013

[22] Filed: Oct. 31, 1991

[51] Int. Cl.[5] ..... B26D 7/18; B31B 1/20

[52] U.S. Cl. ..... 493/373; 83/102; 83/155

[58] Field of Search ..... 493/82, 83, 342, 373; 83/102, 155

[56] References Cited

U.S. PATENT DOCUMENTS 2,508,083 5/1950 Winkler ..... 493/373
2,588,384 3/1952 Hedstrom et al. ..... 493/373
2,888,860 6/1959 Baumgartner ..... 493/373
3,270,929 9/1966 Foster ..... 493/373
3,626,561 12/1971 Luce et al. ..... 493/373
3,834,291 9/1974 Bishop ..... 493/373
4,618,342 10/1986 Borel ..... 493/342

*Primary Examiner*—William E. Terrell
*Attorney, Agent, or Firm*—W. Patrick Quast

[57] ABSTRACT

An apparatus and method for stripping and removing external and internal waste automatically from previously die-cut blanks is described. Independently positionable stripping belts permit stripping external perimeter and internal lengthwise strips of waste material from the blanks, followed by vibrating and brushing the blanks for automatic removal of loosely held internal waste.

14 Claims, 5 Drawing Sheets

WASTE REMOVER FOR DIE CUT BLANKS

DESCRIPTION

1. Technical Field

This invention relates to the field of waste stripping, and more particularly to an automatic apparatus and method for removing external and internal waste from previously die-cut blanks.

In the manufacture of cardboard boxes, corrugated cartons and the like, rectangular sections are die-cut in a conventional manner. The die-cut defines the boundaries of the object to be manufactured. By the very nature of the process areas of waste are created which must be removed. These areas of waste are often externally located, i.e. at the lateral edges of the blank. However, the waste can also be internal, as for example, a die-cut hand grip cut out in the center of the blank, etc. Obviously, this waste must be removed in an efficient manner during fabrication.

2. Background Art

Processing die-cut blanks in the manufacture of cardboard boxes and the like involves handling large numbers of rectangular die-cut blanks in as short a period of time as is practical and possible. The die-cut presents the blanks with the final object of manufacture (e.g. a corrugated carton) in outline, easily separable from the remaining waste portion of the blank, i.e. the unusable portion that is to be separated from the blank and discarded.

Traditionally, the die-cut blanks have been placed in stacks, and the waste portion removed by hand in a time consuming manner. Since these die-cut blanks are usually produced in great numbers automatic waste removal systems are obviously desirable.

Attempts have been made to provide an automatic apparatus for this waste removal as is evidenced by U.S. Pat. Nos. 4,096,981, 4,109,842, and 4,467,948. In U.S. Pat. No. 4,467,948 an apparatus is described wherein stripping belts placed at both sides of a die-cut blank automatically strip away easily separable waste material running lengthwise at the sides of the blank. The process can be made fully automatic by having die-cut blanks automatically fed onto a conveyer belt. The blanks are then conveyed on rollers through the stripping belts, and then onto automatic collection devices while the waste material is automatically conveyed away in the opposite direction to the plane of travel of the blanks.

While the above mentioned devices provide useful methods for efficient waste removal, there are additional problems associated with processing a wide variety of die-cut blanks. For example, the blank may be die-cut so that there is more than one product on the blank, and therefore more than just easily separable waste material on the outer edges of the blank. And die-cut blanks may contain easily separable internal waste material confined within the boundaries of the blank. It is to these additional problems the instant invention is addressed.

DISCLOSURE OF INVENTION

It is an object of the invention to provide an apparatus for automatically stripping external waste from previously die-cut multiple product blanks.

Another object of the invention is to provide for automatic removal of easily separable internal waste material from previously die-cut blanks.

An additional object is to automatically remove internal waste material from previously die-cut blanks in a manner that does no cosmetic damage to the finished product.

An additional object is to provide for a reliable apparatus for external and internal waste removal from die-cut blanks.

A further object is to provide an economic apparatus for the automatic removal of easily separable internal and external waste material from previously die-cut blanks.

These and other objects are achieved in this invention. As has been mentioned above, U.S. Pat. No. 4,467,948 describes an apparatus for automatically stripping external waste, i.e. easily separable material loosely connected at the perimeter of a die-cut blank, downward and away from the usable portion of the blank in a convenient manner. However, in processing previously die-cut blanks it is often necessary to handle what the industry refers to as "multiple outs", i.e. blanks that are die-cut to have more than one ultimate product per blank. The blank may be die-cut to yield, for example, two or four folding boxes. In these instances simply removing the perimeter waste does not do the whole job. There will still be one or more additional strips of waste running the length of the blank.

In the instant invention die-cut blanks are fed onto a conveyer belt at the input end of the waste remover apparatus. The apparatus is arranged in a planar alignment so that the blanks are moved continuously from the conveyer belt into a series of stripping rollers, and finally in stripped, waste removed condition, out of the apparatus and ready for further processing. A single motor is sufficient to power the conveyer belt, stripping rollers, and discharging rollers. While U.S. Pat. No. 4,467,948 teaches the use of two stripping belt systems, one in fixed position at one side of the frame of the apparatus, and a second stripping belt system externally adjusted at the other side of the frame of the apparatus, in the instant invention a plurality of independently positioning stripping belt systems is provided. As the input conveyer belt urges the blanks forward the blanks are caught between rollers spaced transversely to the plane of travel of the blanks. Each stripping belt system is comprised of a pulley and stripping belt, the pulley being positioned above the plane of travel of the blanks, and in vertical alignment with two permanently positioned rollers spaced below and transverse to the blank's plane of travel. The positioning pulley is mounted on a slidable arm which is connected to a shaft which in turn is connected to the frame of the apparatus above and transverse to the blank's plane of travel. As the die-cut blank passes through a "nip" area formed by the pulley and the first of the two permanently positioned rollers, the stripping belt which rotates about the pulley and the permanently positioned rollers catches loosely connected waste material on the die-cut blank, and causes it to be stripped away, downward and in the opposite direction to the plane of travel of the blank. Since a number of positioning pulleys and stripping belts can be used at one time, and positioned at any desired lateral location above the blank, the die-cut blank can be automatically stripped of three or more strips of waste material extending the length of the blank.

The instant invention also provides for the removal of the internal waste on die-cut blanks as well. A die-cut blank may contain an internal waste portion, as, for example, a hand grip cut-out. To remove internal waste the invention utilizes a combination of vibration and brushing. After the die-cut blank has passed through the stripping belts, additional rollers urge the blank forward and into contact with the periphery of wheels positioned on eccentrically shaped hubs which are mounted on a shaft connected to the frame of the apparatus, above and transverse to the blank's plane of travel. A separate motor rotates this shaft, causing the wheels to impart vibrational motion to the blank. The periphery of the wheels are mounted on a ball bearing race so as to move with little or no friction on the surface of the blank, and therefore cause no cosmetic damage to the blank.

The vibration causes the loosely held internal waste to be further loosened. Finally, a brush mounted just after the wheels in the plane of travel of the blanks brushes these loose particles of internal waste away from the surface of the blanks. The brush is mounted on a rotatable shaft connected to the frame of the apparatus, the shaft being positioned below and transverse to the plane of travel of the blanks. The same motor that powers the shaft for the vibration causing wheels provides the power for this brush mounting shaft.

Finally, rollers now catch the leading edge of the now external and internal waste removed blank and discharge the cleaned blank from the waste remover apparatus in condition for further processing such as printing, gluing, folding, etc.

BEST MODE FOR CARRYING OUT THE INVENTION

Figure 1:
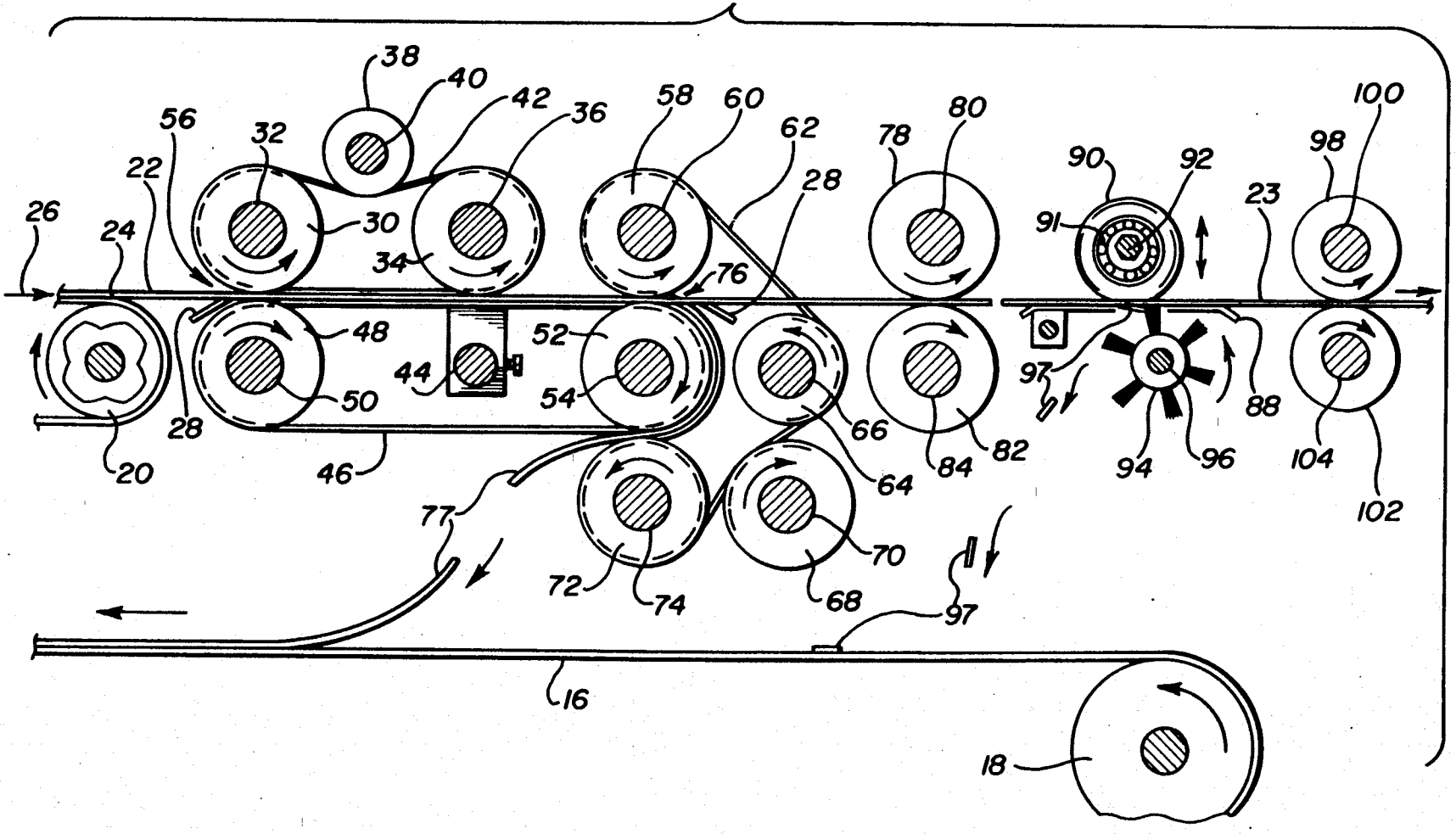
FIG. 1 is a schematic side view showing the planar alignment of the waste remover apparatus of the invention.

Referring now to FIG. 1 the waste remover 10 (FIGS. 2 and 5) is shown in schematic diagram, illustrating the planar alignment of the components of the apparatus in accordance with the desired plane of travel 26 of the previously die cut blanks 22. The blanks to be processed are generally rectangular in shape, and are placed on the input end of conveyer belt 24 (FIG. 3). The blanks will be moved along in this same plane 26 throughout the waste removal process. Motor 106 (FIG. 2) provides the power for feed conveyer belt rollers 20, and to move the blanks through the waste removal portions of the apparatus and out of the discharge end.

Blank 22 moves forward on feed conveyor belt 24 until the blanks leading edge is caught in nip 56 defined by the frictional contact of belt 42 with belt 46 at this point. Belt 46 rotates around driving roller 48 and driven roller 52 with additional support from support bracket 44. Belt 42 is in frictional engagement with belt 46 and rotates around rollers 30 and 34. The tension in belt 42 can be adjusted in a conventional manner by tensioning roller 38. As belts 42 and 46 rotate blank 22 is urged towards positioning pulley 58 and stripping belt 62. An open area bridge 28 supports blank 22 in this section of waste remover 10 to provide areas for convenient waste removal.

As best seen in FIG. 1 stripping belt 62 rotates in a serpentine manner around vertically aligned rollers 52, 72, and forward roller 64. The tension on stripping belt 62 can be adjusted by means of tensioning roller 68. Tensioning roller 68 can be adjusted in a generally upward or downward direction by means of being movably connected at either side of frame 12 within slot 141 (FIG. 3). Lifter arm 135, mounted on support rod 136 (FIG. 4), is connected to tensioning roller 68 to provide said upward and downward motion for tension adjustment of stripping belt 62.

Figure 4:
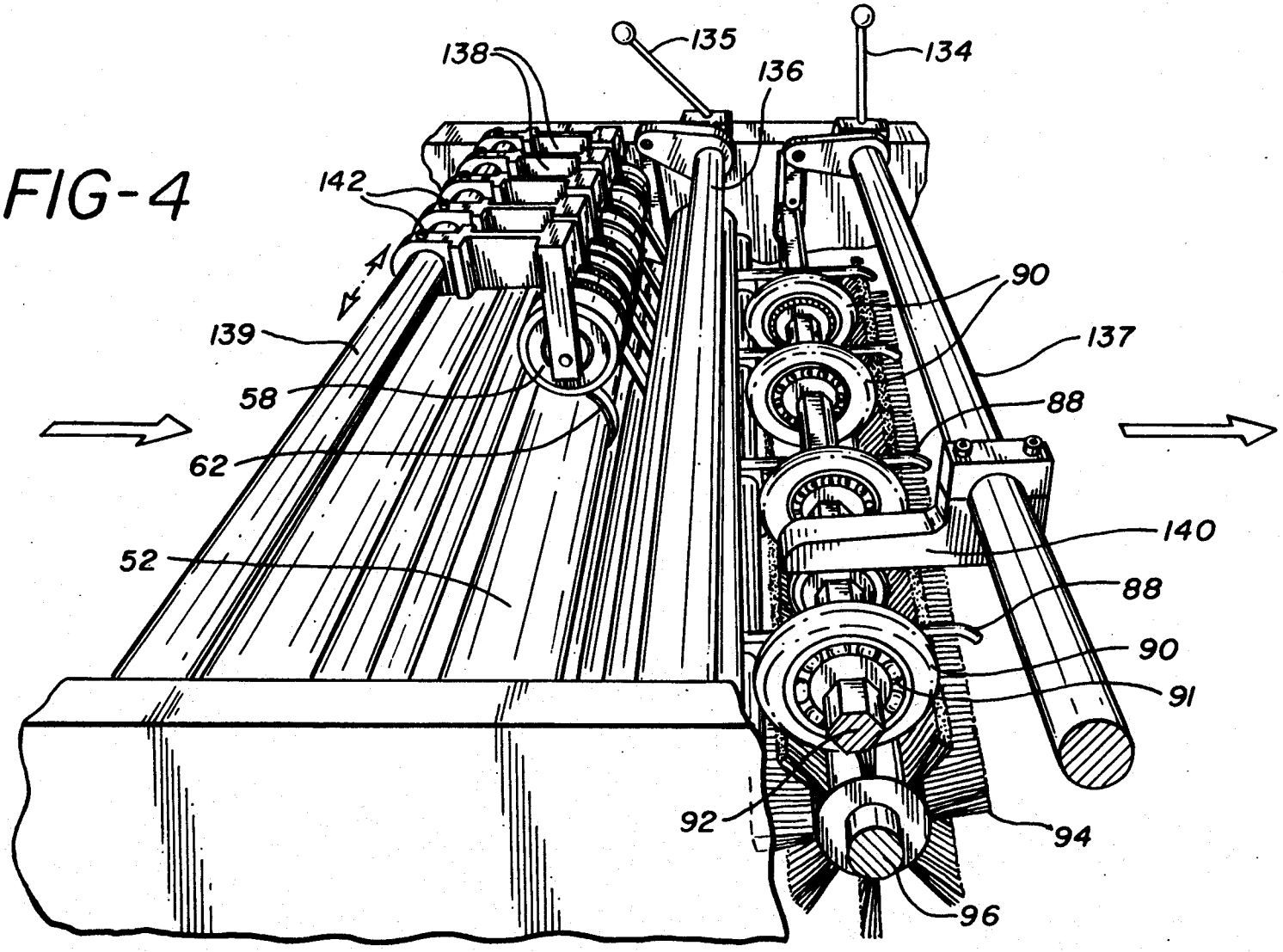
FIG. 4 is a partial perspective view showing the stripping, vibrating, and brushing waste removal means of the invention.
Figure 5:
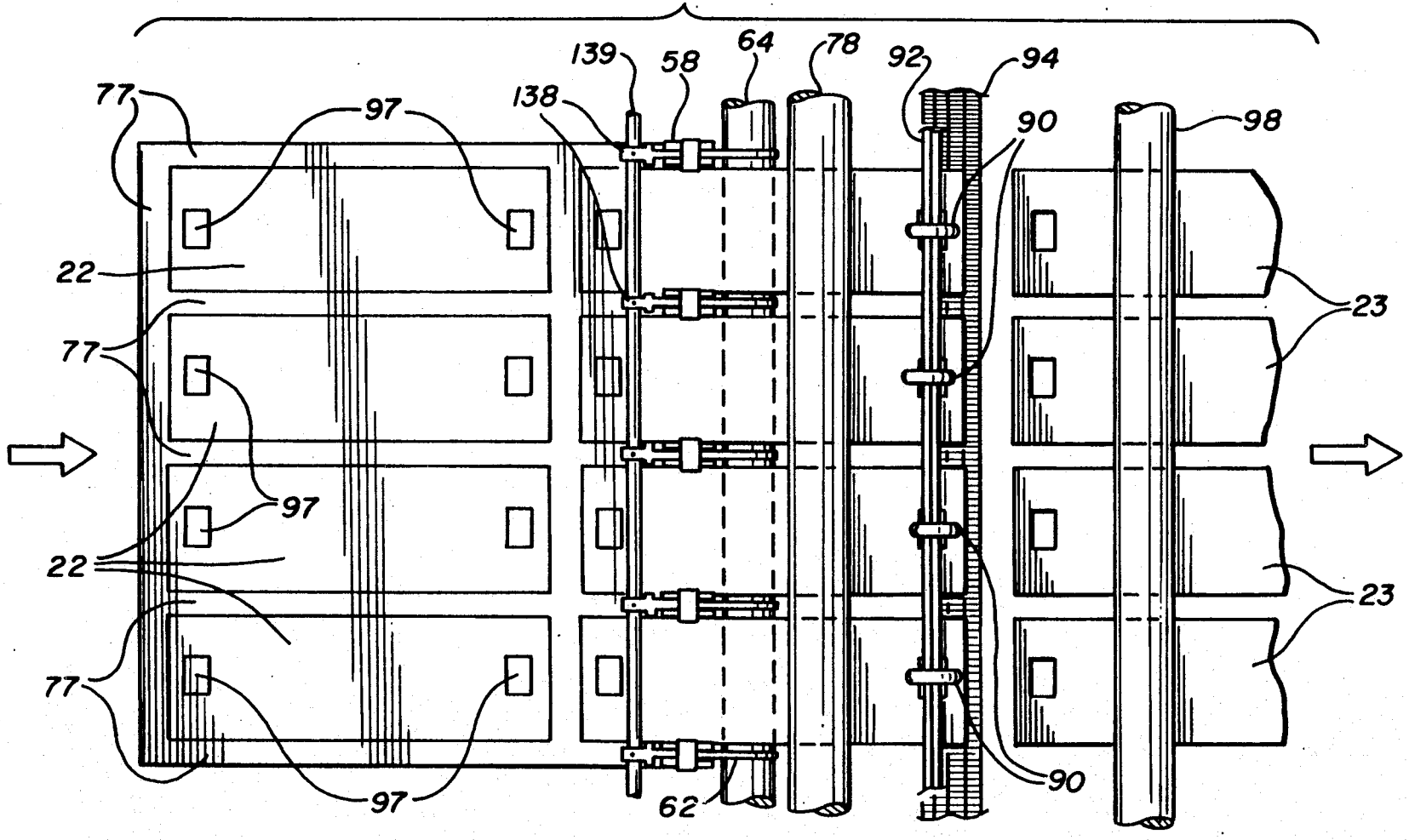
FIG. 5 is a schematic top plan view illustrating external and internal waste being removed from a die-cut blank.

As can be seen in FIGS. 4 and 5 positioning pulley 58 is mounted above the plane of travel of blank 22, but can be set at any lateral left or right position over the blank. Positioning pulley 58 is rotatably mounted on shaft 60 within positioning arm 138, which in turn is slidably connected to support rod 139. Support rod 139 runs the width of frame 12, and connects at both sides. Positioning pulley 58 is in vertical alignment with stationary rollers 52 and 72. Forward roller 64 is also stationary being positioned just ahead of roller 52 in the plane of travel of blank 22.

Depending on the position of the lengthwise strips of waste material 77 (FIG. 5) in blank 22, positioning arm 138 can be set directly over waste portion 77 and secured in this position by set screw 142, and stripping belt 62 can be adjusted to be in vertical alignment with rollers 64, 72, and 52 and positioning pulley 58. When the leading edge of waste portion 77 reaches nip area 76 defined by the contact point of positioning pulley 58 with stationary roller 52, waste portion 77 is caught between stripping belt 62 and the periphery of stationary roller 52, and is torn away from the remainder of blank 22. Waste portion 77 is then conveyed in a downward direction, opposite to the plane of travel of blank 22. After blank 22 has passed completely through the stripping area as defined by nip 76, waste portion 77 falls away from blank 22, and is automatically removed on conveyer belt 16. It is important to note that many positioning pulleys and stripping belts can be used at one time to accommodate a virtually limitless number of configurations of lengthwise stripping requirements die-cut blanks may present.

After blank 22 has had perimeter and lengthwise waste material 77 (FIG. 5) removed, internal waste 97 must still be removed. Blank 22 is caused to move forward towards the discharge end of frame 12 by driving roller 82 and driven roller 78. Roller 78 is spaced above and transverse to the plane of travel of blank 22, and is in frictional contact with driving roller 82 spaced in vertical alignment with roller 78, being positioned below and transverse to the plane of travel of blank 22. Rollers 78 and 82 urge blank 22 forward onto open area bridge 88 (FIG. 4).

At this point in its forward progress blank 22 now encounters a plurality of vibration causing wheels 90 (FIGS. 4 and 5). Wheels 90 have a hexagonal off center slot for mounting on hexagonal shaft 92. Shaft 92 is mounted within grooves at both sides of frame 12, above and transverse to the plane of travel of blank 22.

Shaft 92 is connected to sprocket 128 (FIG. 2) which is connected to chain drive 127 and finally motor 123. Shaft 92 is also connected to lifter arm 134, which in turn is mounted on support bar 137. When not processing blanks with internal waste 97 lifter arm 134 raises shaft 92 and thereby wheel 90 above and out of contact with the blank. When internal waste 97 is present lifter arm 134 lowers shaft 92 downward so that wheel 90 contacts the upper surface of the blank. Turning motor 123 on causes shaft 92 to rotate, and also wheel 90, and to do so in an up or down, eccentric manner. Motor 123 is preferably a variable speed motor, as, for example, 0–1, 700 R.P.M. The eccentric rotary action of wheel 90 causes vibrational motion to be imparted to blank 22. Since the periphery of wheel 90 spins on a ball bearing race 91, wheel 90 is free to rotate at the speed of forward travel of blank 22, independently of the speed of rotation of shaft 92 powered by motor 123. Thus wheel 90 causes blank 22 to vibrate sufficiently to further loosen internal waste 97 in a downward direction with little or no friction being generated by the action of wheel 90 on blank 22.

It is important to note that blank 22 is adequately vibrated without cosmetic damage to the blank. In another embodiment of the invention (not shown) blank 22 was vibrated by a plurality of steel "fingers" attached to a shaft, said shaft rapidly moving up and down in response to an eccentric pulley, causing said steel fingers to move up and down in a drum beating manner on the upper surface of blank 22. While this mechanism imparted satisfactory vibration to blank 22, the beating steel fingers damaged the surface of blank 22, causing a cosmetic defect that might cause the final product to be rejected.

Vibration dampening bar 140 is slidably mounted on support bar 137, with its dampening arm extending laterally to support bar 137, above wheels 90. Dampening bar 140 can be positioned immediately above wheel 90 or shaft 92 to absorb excessive vibration when required.

Immediately after encountering wheels 90, the lower surface of blank 22 is contacted by brush 94. This brush is mounted on rotatable shaft 96 which is positioned below and transverse to the plane of travel of blank 22 on frame 12. On the left side of frame 12 shaft 96 connects to drive sprocket 126 which is powered by motor 123 by means of chain drive 125 and drive sprocket 124. Brush 94 and shaft 92 are both rotated at the same time. As blank 22 continues its forward motion on bridge 88, wheel 90 vibrationally causes internal waste 97 to be further loosened in a downward direction, said internal waste finally being brushed away (FIG. 1) by rotating brush 94. Brush 94 can be fabricated in conventional materials, as, for example, nylon.

The leading edge of now external and internal waste removed blank 23 is caught between driving roller 102 and driven roller 98. Driven roller 98 is positioned above and transverse to the plane of travel of blank 23, and in vertical alignment with driving roller 102 spaced below and transverse to the plane of travel of blank 23. The now waste removed blank is urged forward and out of the discharge end of frame 12.

Figure 2:
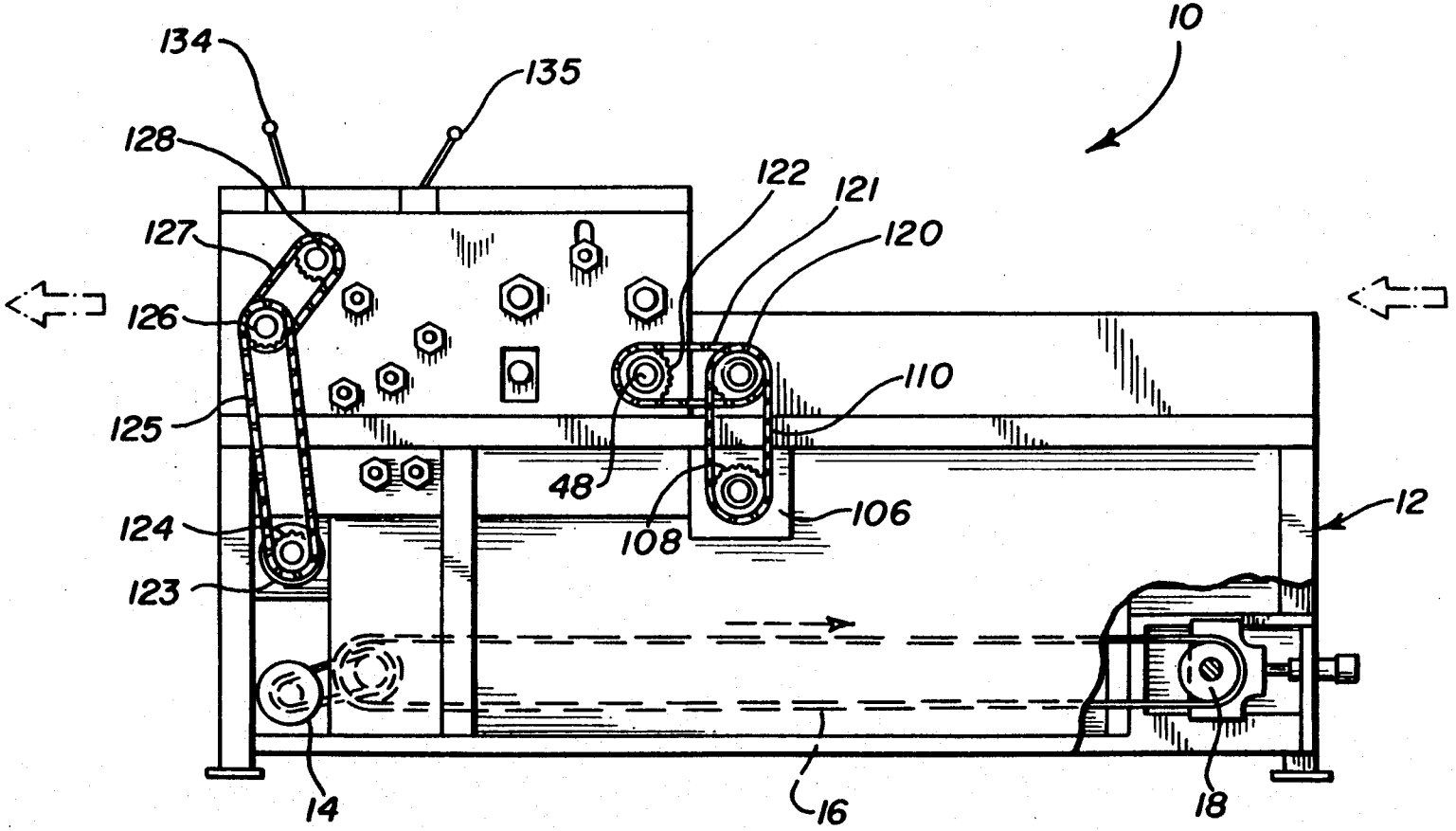
FIG. 2 is a left side elevational view of the waste remover apparatus of FIG. 1.
Figure 3:
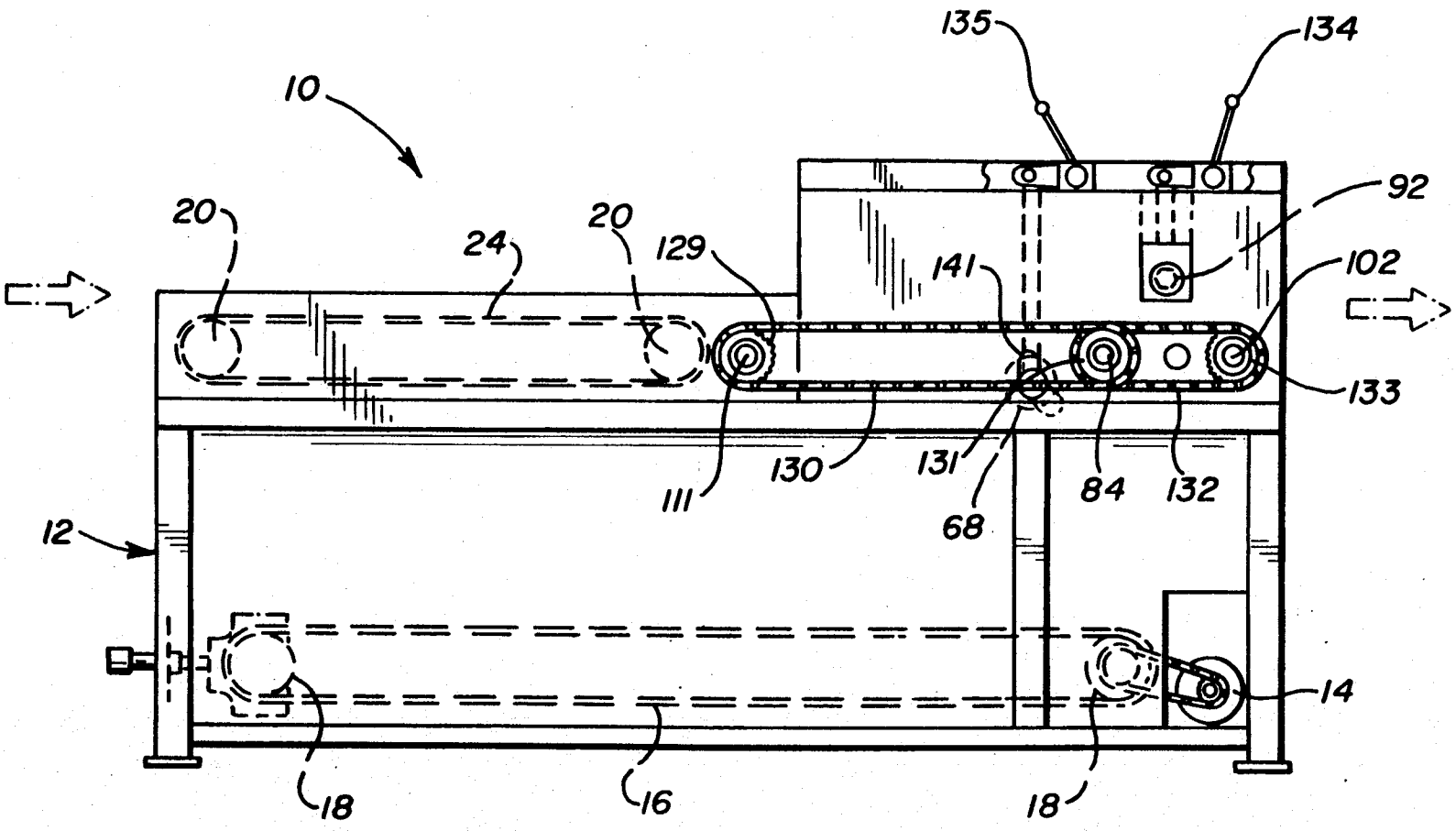
FIG. 3 is a right side schematic elevational view of the waste remover apparatus of FIG. 1.

FIGS. 2 and 3 further illustrate the conveyer mechanism of the invention. Blank 22 is placed on conveyer belt 24, powered by motor 106 through drive sprocket 108 and drive chain 110 to drive sprocket 120 which rotates driving roller 20. Feed conveyer belt 24 rotates around pulleys 20. Drive sprocket 120 also connects to driving shaft 50 by means of drive chain 121, and drive sprocket 122 on the side of frame 12. Driving shaft 111 (within driving roller 20 [FIG. 1]) is connected to drive sprocket 129, which in turn rotates drive chain 130, which then turns drive sprocket 131 (driving shaft 84). Drive chain 132 connects drive sprocket 131 and drive sprocket 133 to drive motor 104. Motor 106 rotates shafts 111, 50, 84, and 104, and their rollers 20, 48, 82, and 102. At the same time belts 24, 46, 42, and 62 together with the frictional alignments of the rollers causes shafts 32, 40, 36, 60, 54, 74, 66, 70, 80, and 100, and their rollers 30, 38, 34, 58, 52, 72, 64, 68, 78, and 98 to rotate. All of the above shafts are caused to rotate in synchronism.

Automatic waste removal is obtained by conveyer belt 16 and rollers 18 powered by motor 14.

The foregoing and other advantages are obvious to those skilled in the art of processing die-cut blanks, and in the operation of automatic die-cut blank processing and related equipment.

What is claimed is:

1. A waste remover for automatically removing waste from usable portions of a previously die-cut blank, said waste remover being arranged in a planar arrangement on a frame, said waste remover having means for automatically conveying said blank through an input end of said waste remover, then into a waste removal portion of said waste remover, and finally into a discharge end of said waste remover wherein said blank is discharged from said waste remover by means for discharging said blank from said waste remover, said blank being conveyed in a generally planar plane of travel from said input end of said waste remover to said discharge end of said waste remover, said waste removal portion comprising: stripping means for removing said waste, said stripping means including means for supporting said blank having sufficient open areas to permit said waste to be driven downward and away from said plane of travel of said blank, said stripping means having at least two stripping belt systems adapted to be independently positioned one from another, each of said stripping belt systems comprising a positioning pulley and a stripping belt, said positioning pulley being positioned above said plane of travel of said blank, said positioning pulley being in vertical alignment with a first permanently positioned roller positioned below and transverse to said plane of travel of said blank, so that as said blank is conveyed to said waste removal portion said blank is caused to pass through a nip area formed by said positioning pulley and said first permanently positioned roller, said pulley being positioned above said first permanently positioned roller, so that said stripping belt, which rotates around said pulley and around a second permanently positioned roller positioned below said first permanently positioned roller and transverse to said plane of travel of said blank, contacts only loosely held waste material connected to said blank at said nip area, and said loosely held waste material is caused to be stripped away from said blank, said waste removed blank now being conveyed to said discharge end of said waste remover, wherein said waste removed blank is discharged from said waste remover by said discharging means.

2. The waste remover of claim 1 wherein said means for conveying said blanks through said input end, said waste removal portion, and said discharge end comprises a motor, a feed conveyer means shaft, a stripping means shaft, a discharge means shaft, and means interconnecting the motor and said shafts to rotate all of said shafts in synchronism.

3. The waste remover according to claim 1 wherein each of said positioning pulleys is slidably mounted on a positioning pulley mounting means connected to said frame, said mounting means being connected above and transverse to said plane of travel of said blank, said positioning positioning pulleys being positioned above and in vertical alignment with said first of said permanently positioned rollers.

4. The waste remover according to claim 3 wherein a plurality of said positioning pulleys with said stripping belts are slidably mounted on said positioning pulley mounting means so that blanks containing a plurality of said waste, running lengthwise the full length of said blanks, have said waste removed automatically by said stripping belts on said permanently positioned rollers.

5. The waste remover according to claim 1 further comprising means for automatically removing internal waste from the interior areas of previously die-cut blanks, said internal waste having sufficient boundaries with the remainder of said usable portion of said blank as to prevent said internal waste from being removed from said blanks by said stripping belts and said permanently positioned rollers.

6. The waste remover according to claim 5 wherein said internal waste is caused to be automatically removed from said usable portion of said blanks by means for first loosening said internal waste from said blank by means for vibrating said blank, and then brushing said loosened waste from said blank by means for bushing said blanks.

7. The waste remover according to claim 6 wherein said means for vibrating said blank comprises:

a. A support means for said blank having sufficient open areas to permit said internal waste to be projected downward from said plane of travel of said blank, and to fall away from said blank; and b. A plurality of eccentrically mounted wheels for eccentric rotation upon said blank, thereby imparting vibration to said blank due to said eccentric rotation, whereby said vibration causes said internal waste to be further loosened from said usable portion of said blank, and to be placed in a position to fall away from said blank.

8. The waste remover according to claim 7 wherein said wheels are mounted on a rotatable shaft mounted on said frame above and transverse to said plane of travel of said blank.

9. The waste remover according to claim 8 wherein said rotatable shaft is powered by a separate motor from said motor for said feed conveyer shaft, said stripping means, and said discharge shaft.

10. The waste remover according to claim 8 wherein said wheel contains a ball bearing race so that the periphery of said wheel is free to rotate at speeds determined by the speed of the die-cut blanks along their plane of travel, independently of the speed of rotation of said rotatable shaft upon which said wheels are mounted.

11. The waste remover according to claim 6 wherein said brushing means comprises a brush, said brush being mounted on a rotatable shaft, said rotatable shaft being connected to said frame, said brush and said shaft being mounted beneath and transverse to the plane of travel of said blank, said brush being spaced ahead of said vibrating means in said plane of travel of said blank, the periphery of said brush contacting the underside of said blank, said means for brushing further comprising means for rotating said brush.

12. The waste remover according to claim 6 wherein said means for vibrating said blank comprises a wheel mounted off center on a rotatable shaft connected to said frame above said plane of travel of said blank, the periphery of said wheel being connected to a ball bearing race to impart independent rotation from said shaft to said wheel, said means for brushing said blank comprising a brush mounted on a rotatable shaft spaced ahead of said wheel and beneath said blank, said wheel and said brush being interconnected for transmission of power from a separate motor, said separate motor being different from said motor for said feed conveyer shaft, said stripping means shaft, and said discharging means shaft, so that as die-cut blanks transverse the distance between said input end and said discharge end of said frame said external waste is removed by said stripping means, and said waste is removed by the combined action of said vibration imparted by said wheel, and said brushing imparted by said brush.

13. The waste remover according to claim 12 further comprising means for raising said wheel out of contact with said blank when the action of said wheel is not required.

14. The waste remover according to claim 12 further comprising means for dampening said vibration.

* * * * *

UNITED STATES PATENT AND TRADEMARK OFFICE

CERTIFICATE OF CORRECTION

PATENT NO. : 5,197,938

DATED : March 30, 1993

INVENTOR(S) : Jan Chmielewski

It is certified that error appears in the above-identified patent and that said Letters Patent is hereby corrected as shown below:

At column 8, line 39 remove the word "external".

At column 8, line 40 insert the word --internal-- before the word "waste".

Signed and Sealed this

Thirtieth Day of November, 1993

Bruce Lehman

*Attest:*

BRUCE LEHMAN

*Attesting Officer*

*Commissioner of Patents and Trademarks*